United States Patent [19]

Tasseron

[11] 4,061,239

[45] Dec. 6, 1977

[54] CLOSURE FOR A CONTAINER

[75] Inventor: Frans A. W. Tasseron, Heemstede, Netherlands

[73] Assignee: Koninklijke Emballage Industrie Van Leer B.V., Amstelveen, Netherlands

[21] Appl. No.: 749,515

[22] Filed: Dec. 10, 1976

[30] Foreign Application Priority Data

Dec. 12, 1975 Netherlands ..... 7514516

[51] Int. Cl.[2] ..... B65D 55/02; B65D 85/56; A61J 1/00

[52] U.S. Cl. ..... 215/221; 215/273; 215/279

[58] Field of Search ..... 215/216, 217, 218, 221, 215/225, 273, 279

[56] References Cited

U.S. PATENT DOCUMENTS

| | | | |
|---|---|---|---|
| 3,633,779 | 1/1972 | Field | 215/221 X |
| 3,826,395 | 7/1974 | Montgomery | 215/221 |

*Primary Examiner*—George T. Hall

*Attorney, Agent, or Firm*—Stevens, Davis, Miller & Mosher

[57] ABSTRACT

A lockable cap for a screw top container having an annular element with a plurality of upwardly extending hooks, the element is held in place by a groove beneath the container screw threads. The cap has an annular wall defining an inverted U-shaped hollow into which the hooks project and lock the cap. The hooks can be manually compressed radially-inwardly to unlock them.

2 Claims, 2 Drawing Figures

CLOSURE FOR A CONTAINER

The present invention relates to a closure for a container having a neck provided with screw threads formed on the exterior surface of said neck and a cap which is screwed on said neck, said cap in its closure position engaging an annular body being locked in the groove of the neck lying beneath the screw thread of said neck. Closures of this kind are generally known. Usually, the cap has a disengageable connection with a lower edge constituting part of the cap, said edge gripping beneath a peripheral rim confining the groove upwardly. Once this known closure has been opened, whereby the disengageable connection is broken, a locking of the closure position after closing the container by screwing on the cap again is not again possible. Everybody, i.e. also children, will then have access to the contents of the container, which is a considerable disadvantage, particularly when the contents consists of unsafe substances.

It is the object of this invention to provide a closure for a container which may be opened and locked again each time and which is embodied such that it is impossible for children to remove the closure.

In accordance with this invention, said object is achieved in that the cap comprises a wall, said wall with the threaded part of the cap constituting their inner U-shaped hollow space, said wall having an inwardly facing edge, and the body locked in the groove of the neck having an upwardly directed flexible wall, said wall projecting in the U-shaped hollow space and engaging with the inwardly directed edge of said wall by means of outwardly extending hooks.

For opening the container, all outwardly extending hooks have to be moved inwardly so that disengagement of the cap wall is effected and only after said disengagement has been realized is it possible to unscrew the cap. The number of hooks determines the degree of difficulty; the more hooks, the more difficult it is to unscrew the cap. Preferably, the flexible wall of the body secured on the neck of the bottle comprises a large number of raised lugs which are only connected with each other near their inner peripheral positions and between which, as seen in circumferential direction, slits are present. Pressing in all hooks in order to disengage the cap is in case of a large number of hooks only possible when the body can be grasped with the thumb and forefinger so that all hooks are pressed inwards. A very small hand, e.g., the one of a child, cannot succeed in doing this and the child will, therefore, not be able to disengage all hooks. This means that the diameter of that part of the body where the hooks are present and which thumb and forefinger should touch, should be adjusted to the current sizes of the hands of adults. This means that, dependent on the destination locale of the container and/or its use, the size of the hands of people in those places should be taken into account.

The same principle, however, may also be applied when the cap has a diameter which at the region of the body with the hooks is larger or smaller than the radius which is determined by the size of the hand (thumb and forefinger). In doing so, however, preferably a small number of lugs is applied. An embodiment is conceivable in which the fingers of both hands can press all lugs and hooks inwardly and in which the lugs and hooks are maintained in this position by the fingers of one hand so that the cap may be screwed off with the other hand.

When the cap is screwed on it will move the hooks back automatically until they will snap again behind the edge of the wall of the cap.

The invention will now be explained more in detail with reference to the drawings in which.

Figure 1:
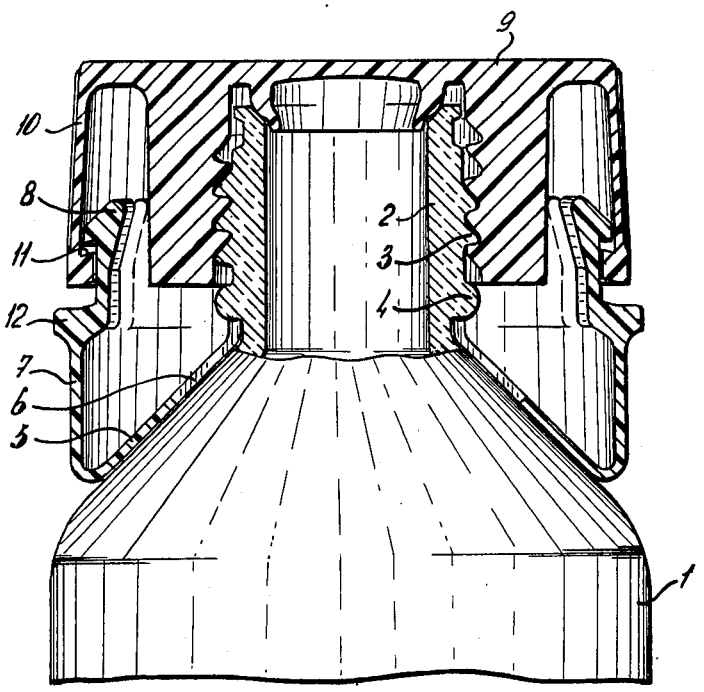
FIG. 1 is a sectional view of the closure according to the invention.
Figure 2:
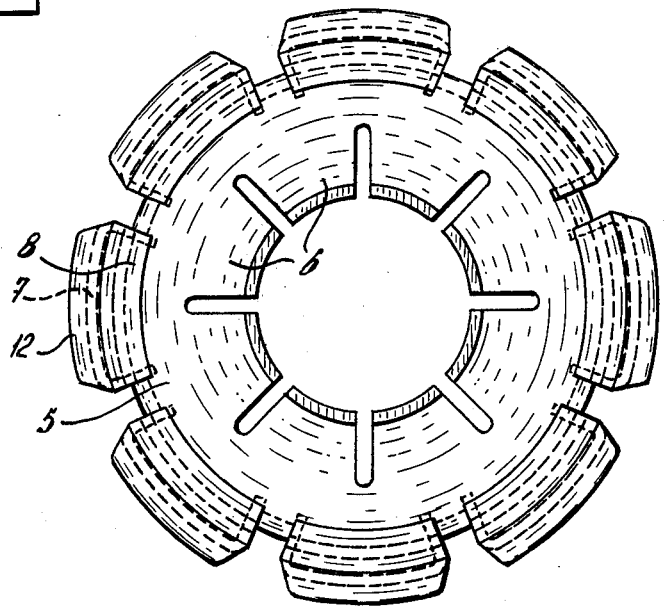
FIG. 2 is a top view of the lower section of the closure.

FIG. 1 shows a bottle 1 with neck 2, said neck being provided with screw threads 3 on its exterior surface, as well as with a rim 4 disposed beneath the screw thread. This type of bottle with a neck represents the most current embodiment and, usually, a cap is placed on the bottle, said cap having an edge gripping beneath the rim 4 and having a disengageable connection with the cap itself so that the connection will be broken when the cap is being unscrewed as a result of which the cap does not act after initial opening as a locking device on the neck.

In accordance with the invention, a body 5 is disposed on the top portion of the bottle, said body gripping beneath the rim 4 with resilient lugs 6 and having on its outer periphery raised lugs 7, the upper ends of which are provided with outwardly extending hooks 8.

The cap 9 comprises a wall 10 and an inwardly directed hooked edge 11. Hooks 8 are disposed above said edge so that said edge will get stuck on the hooks when the cap is being screwed off. The lugs are provided with a projecting edge 12 so that the hooks can be pressed inwards and thus, release the wall of the cap and, therewith, the cap itself. It is necessary to unlock all hooks simultaneously. To that end, the edges 12 lie on a circle which can be spanned by thumb and forefinger of one hand or by the thumb and another finger.

However, it is also possible to construct the locking element with only a few lugs having e.g. three to five hooks, disposed at any circle, which may be pressed inwards with both hands and which may then be maintained in that position with the fingers of one hand, e.g. by holding two at once with one finger.

These are actions which children cannot or can hardly manage, as a result of which a closure is obtained which is safe and which can be applied to any known bottle which is provided with screw thread and with a rim beneath said screw thread.

What we claim is:

1. In a closure for a container having a neck provided with screw threads formed on the exterior surface of said neck and a cap screwed on said neck, said cap in its closure position engaging an annular body which is locked in a groove of the neck beneath the screw thread thereof, the improvement comprising the cap having a wall, said wall with the threaded part of the cap constituting an inverted U-shaped hollow space, said wall having an inwardly facing edge, and the annular body having an upwardly directed flexible wall, said wall projecting into the U-shaped hollow space and having a plurality of outwardly extending hooks engaging with the inwardly directed edge of said wall.

2. A closure in accordance with claim 1, in which the flexible wall has a large number of raised lugs, said lugs being connected with each other only near their inner peripheral portions and between which, as seen in circumferential direction, slits are present.

* * * * *